US006301819B1

(12) United States Patent
O'Dwyer

(10) Patent No.: US 6,301,819 B1
(45) Date of Patent: Oct. 16, 2001

(54) BARREL ASSEMBLY WITH AXIALLY STACKED PROJECTILES

(75) Inventor: James Michael O'Dwyer, Brisbane (AU)

(73) Assignee: Metal Storm Pty Ltd ACN, Brisbane (AU)

( * ) Notice: Subject to any disclaimer, the term of this patent is extended or adjusted under 35 U.S.C. 154(b) by 0 days.

(21) Appl. No.: 09/590,435

(22) Filed: Jun. 9, 2000

Related U.S. Application Data

(62) Division of application No. 08/983,505, filed as application No. PCT/AU96/00459 on Jul. 19, 1996, now Pat. No. 6,138,395.

(30) Foreign Application Priority Data

Jul. 19, 1995 (AU) ..... PN4265

(51) Int. Cl.[7] ..... F41A 19/00
(52) U.S. Cl. ..... 42/84; 102/438
(58) Field of Search ..... 42/84; 102/438, 102/217

(56) References Cited

U.S. PATENT DOCUMENTS 3,412,681 * 11/1968 Shirneker ..... 102/38
3,815,271 * 6/1974 Lynn ..... 42/84
3,854,231 * 12/1974 Broyles ..... 42/84
5,883,329 * 3/1999 O'Dwyer ..... 102/217
6,123,007 * 9/2000 O'Dwyer ..... 42/84
6,223,642 * 5/2001 O'Dwyer ..... 89/7

* cited by examiner

*Primary Examiner*—Charles T. Jordan
*Assistant Examiner*—Denise Buckley
(74) *Attorney, Agent, or Firm*—Amster, Rothstein & Ebenstein

(57) ABSTRACT

A barrel assembly (10) having a plurality of projectiles (11) stacked axially within the barrel (12) together with discrete selectively ignitable propellant charges (13) for propelling the projectiles (11) sequentially through the muzzle of the barrel (12) is provided with adjacent projectiles (11) separated from one another by locating means (13) independent of the projectiles. The locating means may be a solid propellant charge (13) located between adjacent projectiles or it may be a rigid casing (122) for the propellant. When subject to an in-barrel load a rear skirt portion of the active projectile (11) is expanded outwardly by the interaction between an inwardly reducing recess (14) formed in the rear end of a projectile and the nested complementary leading portion of the propellant charge (13) or propellant casing (122).

2 Claims, 15 Drawing Sheets

BARREL ASSEMBLY WITH AXIALLY STACKED PROJECTILES

CROSS REFERENCE TO RELATED APPLICATION

The present application is a divisional of U.S. Ser. No. 08/983,505 now U.S. Pat. No. 6,138,395, filed Apr. 7, 1998. Which is a of PCT/AU96/00459 Jul. 19, 1996.

TECHNICAL FIELD

The invention relates to munitions and firearms.

This invention has particular, but not exclusive, application to a barrel having a plurality of projectiles stacked axially within the barrel together with discrete selectively ignitable propellant charges for propelling the projectiles sequentially through the muzzle of the barrel. Such barrels will be referred to hereinafter as of the type described.

1. Background Art

International Patent Application No. 94/20809 relates to firearms of the type described. Field tests of prototype versions of firearms utilizing barrels of the type described have shown that such barrel assemblies perform to expectations. However the inventor has proposed useful variations, including munitions, as well as improvements which may assist in either the efficient production of such firearms or facilitate their performance or useability. Furthermore the inventor envisages that single barrel rates of fire in excess of 40,000 rounds/minute may be achievable in practice and this possibility creates further scope for munitions of conventional style and firearms utilizing barrels of the type described.

2. Disclosure of Invention

According to one aspect this invention provides a barrel assembly of the type described, wherein:

adjacent projectiles are separated from one another and maintained in spaced apart relationship by locating means separate from the projectiles, and each projectile includes expandable sealing means for forming an operative seal with the bore of the barrel.

The locating means may be the propellant charge between adjacent projectiles and the sealing means suitably includes a skirt portion of each projectile which expands outwardly when subject to an in-barrel load. The in-barrel load may be applied during installation of the projectiles or after loading such as by tamping to consolidate the column of projectiles and propellant charges or it may result from the firing of an outer projectile and particularly the adjacent outer projectile.

The propellant charge may be form as a solid block to operatively space the projectiles in the barrel or the propellant charge may be encased in metal or other rigid case which may include an embedded primer having external contact means adapted for contacting an pre-positioned electrical contact associated with the barrel. For example the primer could be provided with a sprung contact which may be retracted to enable insertion of the cased charge into the barrel and to spring out into a barrel aperture upon alignment with that aperture for operative contact with its mating barrel contact. If desired the outer case may be consumable or may chemically assist the propellant burn. Furthermore an assembly of stacked and bonded or separate cased charges and projectiles may be provide for reloading a barrel.

The rear end of the projectile may be formed with a skirt about an inwardly reducing recess such as a conical recess or a part-spherical recess or the like into which the propellant charge portion extends and about which rearward movement of the projectile will result in radial expansion of the projectile skirt. This rearward movement may occur by way of compression resulting from a rearward wedging movement of the projectile along the leading portion of the propellant charge it may occur as a result of metal flow from the relatively massive leading part of the projectile to its less massive skirt portion.

Alternatively the projectile may be provided with a rearwardly divergent peripheral sealing flange or collar which is deflected outwardly into sealing engagement with the bore upon rearward movement of the projectile. Furthermore the sealing may be effected by inserting the projectiles into a heated barrel which shrinks onto respective sealing portions of the projectiles. Then again the projectile may comprise a relatively hard mandrel portion located by the propellant charge and which cooperates with a deformable annular portion supported thereabout for expansion into operative sealing engagement with the bore. The deformable annular portion may be moulded about the mandrel to form a unitary projectile which relies on metal flow between the nose of the projectile and its tail for outward expansion about the mandrel portion into sealing engagement with the bore of the barrel.

In a further embodiment the projectile assembly includes a rearwardly expanding anvil surface supporting a sealing collar thereabout and adapted to be radially expanded into sealing engagement with the barrel bore upon forward movement of the projectile through the barrel. In such embodiment it is preferred that the propellant charge have a cylindrical leading portion which abuts the flat end face of the projectile.

If desired, the projectiles may be adapted for seating and/or location within circumferential grooves or by annular ribs in the bore or in rifling grooves in the bore and may include a metal jacket encasing at least the outer end portion of the projectile. The projectile may be provided with contractible peripheral locating rings which extend outwardly into annular grooves in the barrel and which retract into the projectile upon firing to permit its free passage through the barrel.

In another aspect this invention resides broadly in a method of electrical ignition for sequentially igniting the propellant charges of a barrel assembly of the type described, including:

igniting the leading propellant charge by sending an ignition signal through the stacked projectiles, and causing ignition of the leading propellant charge to arm the next propellant charge for actuation by the next ignition signal. Suitably all propellant charges inwardly from the end of a loaded barrel are disarmed by the insertion of respective insulating fuses disposed between normally closed electrical contacts.

Ignition of the propellant may be achieved electrically or ignition may utilise conventional firing pin type methods such as by using a centre-fire primer igniting the outermost projectile and controlled consequent ignition causing sequential ignition of the propellant charges of subsequent rounds. This may be achieved by controlled rearward leakage of combustion gases or controlled burning of fuse columns extending through the projectiles.

In another form the ignition is electronically controlled with respective propellant charges being associated with primers which are triggered by distinctive ignition signals. For example the primers in the stacked propellant charges may be sequenced for increasing pulse width ignition requirements whereby electronic controls may selectively send ignition pulses of increasing pulse widths to ignite the propellant charges sequentially in a selected time order. Preferably however the propellant charges are ignited by a set pulse width signal and burning of the leading propellant charge arms the next propellant charge for actuation by the next emitted pulse.

Suitably in such embodiments all propellant charges inwardly from the end of a loaded barrel are disarmed by the insertion of respective insulating fuses disposed between normally closed electrical contacts, the fuses being set to burn to enable the contacts to close upon transmission of a suitable triggering signal and each insulating fuse being open to a respective leading propellant charge for ignition thereby.

A number of projectiles can be fired simultaneously, or in quick succession, or in response to repetitive manual actuation of a trigger, for example. In such arrangements the electrical signal may be carried externally of the barrel or it may be carried through the superimposed projectiles which may clip onto one another to continue the electrical circuit through the barrel, or abut in electrical contact with one another. The projectiles may carry the control circuit or they may form a circuit with the barrel.

An advantage which is likely to be gained from dispensing with externally fired primers is the removal of lateral forces within the barrel from firing of the wall mounted primers and the resultant uneven deposit from the primer firing on the projectile and/or barrel. This may increase the accuracy of such weapons and simplify refurbishing of used barrels.

In a further aspect this invention resides broadly in a cased round including:

a case adapted for retention in a breech assembly;

at least two projectiles disposed one behind the other in the case and each being sealably engaged therewith;

respective propellant charges within the case and behind each projectile, and ignition means for igniting the charges in a predetermined sequence. The ignition means may be an electrical ignition means of the type described above or in the abovementioned earlier International Patent Application, but preferably the ignition means utilises mechanical operation of pin fired primers.

The pin fired primer may be adapted to ignite the outermost propellant charge which burns back to ignite the rear charge, but preferably the case is provided with respective primers associated with separate pins for firing the primers. Suitably the primers includes a centre-fire primer associated with a rearwardly extending tubular central spine of the rearmost projectile assembly providing a gas path or burn path for conveying the primer burn to the forward propellant and a rim-fire primer for igniting the rear propellant charge. Alternatively the hollow rear spine may be independent of the rear projectile and support an extension pin conveying the mechanical pin action to a primer supported at within or forwardly of the rear projectile and communicating with the forward propellant.

If desired the centre-fire primer may be associated with the rear propellant charge and the rim fire primer may be disposed in the casing wall in direct communication with the outermost or an outer charge.

The mechanical impacts with the primers may be in quick succession so as to enable both projectiles to be fired sequentially at a rapid rate, such as at a rate of greater than 40,000 rounds per minute. For this purpose where both primers are associated with the base of the cartridge the firing pins may be formed integrally, with the outer pin being slightly shorter than the central pin for the required actuating delay. Suitably the cased ammunition is adapted for use with a rifle or hand gun which includes a preset time delay for, or be provided with a selectively variable timing differential between, actuation of the firing pins.

The timing of the firing of a pair of adjacent projectiles in the above cased ammunition embodiment or in the barrel assembly may be such as to delay ignition of the forward propellant until after the adjacent projectiles have moved as an assembly part-way down the barrel in response to ignition of the rear propellant. This arrangement is proposed as a means of increasing the velocity of the forward projectile. That is the kinetic energy of the rear projectile of a pair of projectiles is sacrificed to enhance the kinetic energy of the front projectile. Alternatively the firing of the rear propellant may follow the firing of the forward propellant simultaneously or almost immediately while the leading projectile remains in the barrel to impart its effect, at least in part, to the forward projectile.

Another variation of the present invention which may be applied to the barrel version or the cased ammunition version of the invention aims to deflect the projectile from its axial path on exiting the barrel by providing a gas bypass passage adjacent the muzzle which feeds propellant gases back to the barrel in the path of the projectile so as to deflect its trajectory from the end of the barrel. In a preferred form such modified barrels are arranged as a cluster of barrels with the bypass bleed inlets innermost so that the lateral reaction forces produced cancel one another.

Furthermore ammunition utilizing a rearwardly extending spine may be provided with flight stabilizers such as fins which may be utilized to cause rotation of the projectile to cause rotation in a projectile fired from a smooth bore barrel, or to provide a non-rotating flight projectile. Additionally, projectiles may utilize a spine which projects forwardly from the nose of the projectile to provide the separation for propellant. Where means are used to induce rotation of the projectile such as barrel rifling, it may be advantageous to form the two part projectiles with opposite hand coarse or fine joining threads so that the rotation caused by the rifling tends to bind the parts together and not separate them as may be the case where the two part junction does not inhibit independent axial rotation of the projectile parts.

BRIEF DESCRIPTION OF DRAWINGS

In order that this invention may be more readily understood and put into practical effect, reference will now be made to the accompanying drawings which illustrate typical embodiments of the present inventions.

FIG. 1 illustrates a barrel assembly 10 of the type described having spaced projectiles 11 loaded within the barrel 12 in spaced relationship and separated by respective propellant blocks 13. As illustrated each projectile 11, which may be formed of lead or other malleable material, is provided with a part-conical recess 14 at its trailing end to accommodate the correspondingly shaped leading portion 15 of the propellant block 13. The main body 16 of the propellant block 13 is cylindrical and its rear end is recessed to closely accommodate the nose 17 of the next-in-line projectile 18. In this embodiment, external primers 19 extend through the wall of the barrel 12 whereby ignition of the respective propellant blocks can be controlled by an external electronic control circuit, not illustrated.

In use, the firing of a forward projectile 11 results in a reaction force being applied of the next projectile 18 which either moves rearwardly over the conical portion of the propellant to wedge into tight sealing engagement with the inner wall of the barrel 12 or deforms without movement relative to the projectile by metal flow towards the rear of the projectile to effect the seal with the inner wall of the barrel 12. Thereafter, upon ignition of the following propellant block, the seal so formed will provide the necessary barrier against propellant gases escaping to ensure effective energy transfer to the projectile 18.

Figure 1:
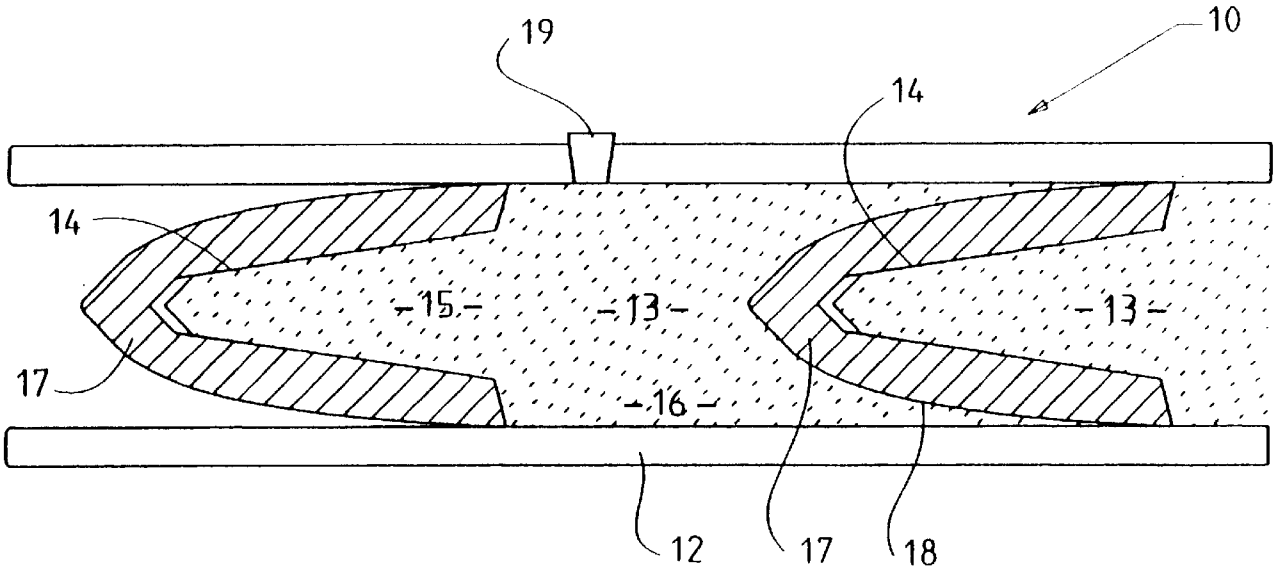
FIG. 1 is a sectional view of part of a barrel assembly utilising propellant spacing of projectiles.
Figure 2:
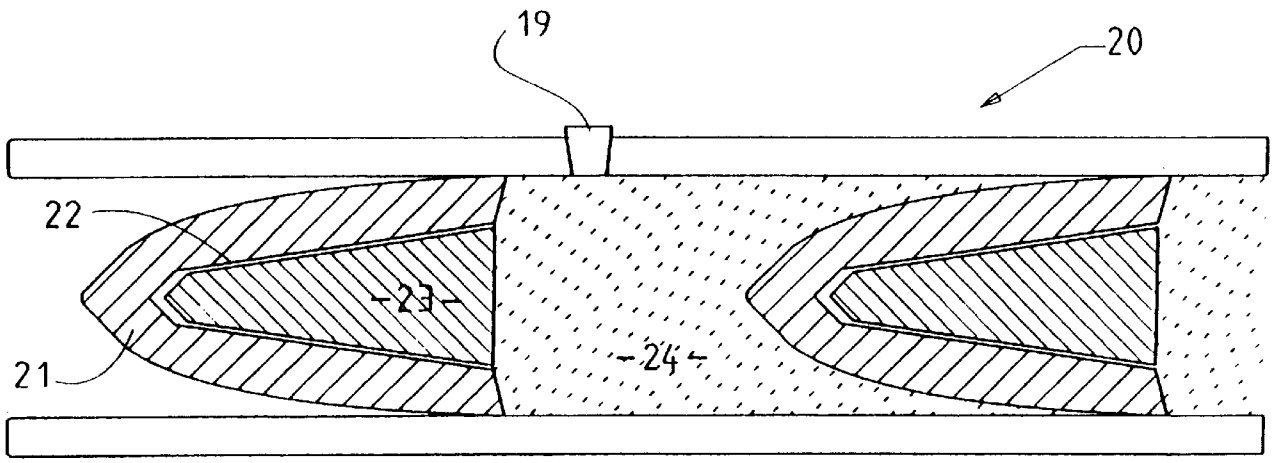
FIG. 2 is a sectional view of a further form of barrel assembly utilising propellant spacing of projectiles.

The barrel assembly 20 illustrated in FIG. 2 is similar to that illustrated in FIG. 1 except that the projectile 21 is a two part projectile containing a head part 22 and an anvil part 23 which abuts the relatively flat front face of the propellant block 24 and which performs the same sealing function as the conical portion of the propellant of FIG. 1.

Figure 3:
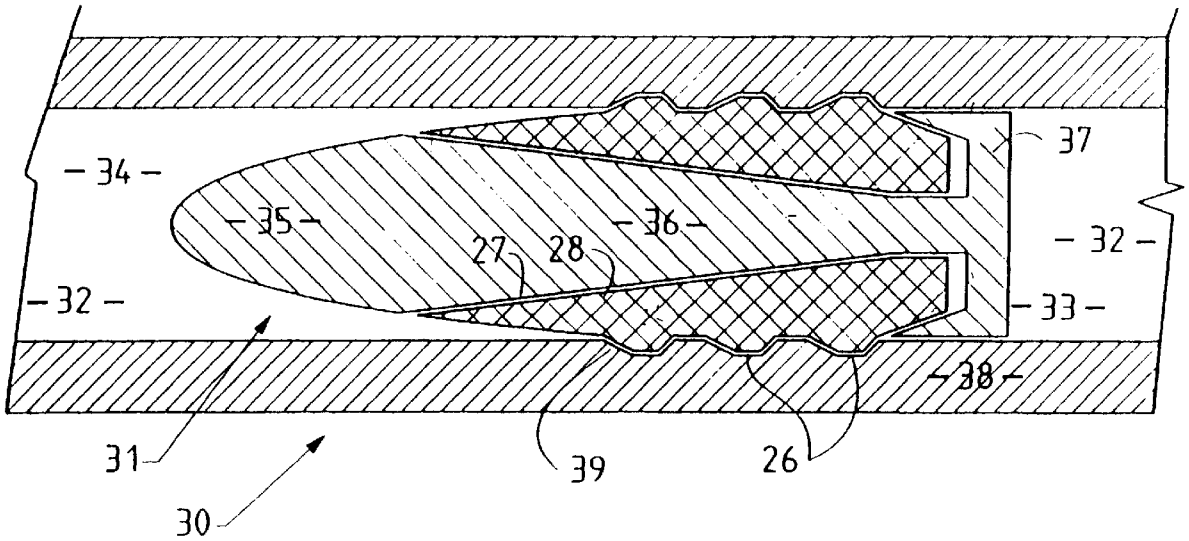
FIG. 3 is a sectional view of part of a barrel assembly of another embodiment of the invention utilising propellant spacing of projectiles.

FIG. 3 illustrates portion of a further barrel assembly 30 of the type described in which a series of projectile assemblies 31 are spaced apart by solid propellant charges 32 which have a plain cylindrical leading portion 33 and a recessed rear portion 34 to accommodate the nose of the following projectile. In this embodiment, the projectile has a steel spine 36 integral with a nose 35 and end cap 37 which is a sliding fit within the barrel 38 and seats against the front face of the propellant charge 32. A collar 39 of more dense material such as lead or the like extends about the forwardly expanding spine portion and into recesses 26 formed in the bore. The collar may be encased in a thin-walled metal jacket in known manner.

In this embodiment, the projectile assembly is seated fully in position either by tamping against the nose 35 during assembly so as to force the spine 36 rearwardly, whereby the interaction of the complementary conical faces 27 and 28 expands the collar 39 outwardly into sealing engagement within the grooves 26 in which they are initially set, or by the reaction from ignition of the leading propellant. The leading faces of the grooves 26 are more inclined than the rear faces of the groove, as illustrated, so as to assist in disengagement of the collar upon firing.

In such embodiments as described above, the amount of propellant supported between projectile assemblies is not limited by the length of the spine between propellants as in a barrel of the type described and having slender columns independent of the propellant separating the projectiles. Thus such embodiments may be useful in providing high muzzle velocity projectiles.

In my earlier barrels of the type described, the firing of the propellant has been achieved by the use of externally mounted primers associated with an external electronic control circuit. However in the embodiment of the invention illustrated in FIG. 4, each projectile assembly 40 includes an electrically conductive spine assembly 41 having a central portion which abuts with the adjacent projectile assemblies to form a continuous column and an electrical circuit branch throughout the length of the barrel.

The spine assembly 41, which in this embodiment also includes a central tapered mandrel portion 42 is insulated by an insulating layer 43 from the projectile head 44. The spine assemblies 41 abut at 45 whereby the electrical circuit is continued through the column of superimposed spine assemblies. A spring contact portion 48 extends forwardly from the leading end portion 46 of the spine assembly 41 and contacts the spine of the next projectile to complete the circuit branch and a fixed contact 49 is supported in the insulated space 43 between the spine assembly 41 and the head 44. The fixed contact 49 is connected by lead 47 to one side of an electrically operated primer 50 which is also connected by lead 51 to the electrically conductive head 44 which is in electrical contact with the barrel 53.

In this embodiment, each primer 50 is pulse sensitive for ignition upon receipt of a suitable signal and the contacts 48 and 49 are spaced apart by an insulating fuse 52 which extends through the nose of the projectile for ignition by the burn of the leading propellant charge. Thus in operation, an electrical pulse may be sent to the outermost primer to ignite the associated propellant and propel the first projectile assembly from the barrel.

That action will ignite the insulating fuse 52 which will maintain the contacts 48 and 49 apart for sufficient time to ensure that the following propellant is not ignited until after the contacts 48 and 49 come together to close the open circuit condition. The following primer may then be ignited at any time by sending the appropriate pulse through the circuit.

It is considered that reliability of the front contacts will be assured after firing as the carbon remnants of the charge or fuse will provide the appropriate electrical path between the contacts 48 and 49 even if they do not come into contact with one another. Thus, no external electrical wiring is required and such barrels may be stacked in close abutting relationship to form a compact weapon.

Figure 4:
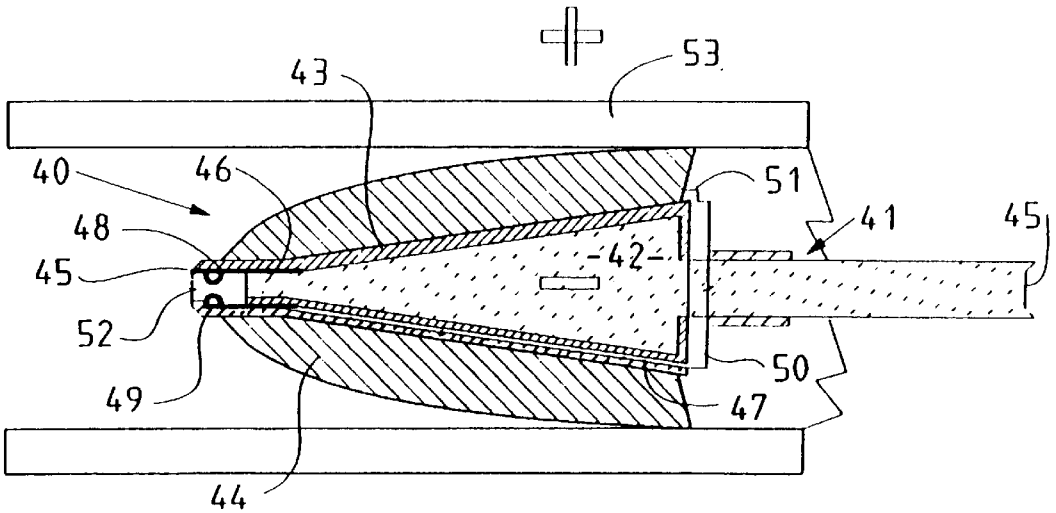
FIG. 4 is a sectional view illustrating an internal ignition system of a barrel assembly utilising spine spacing of projectiles.
Figure 5:
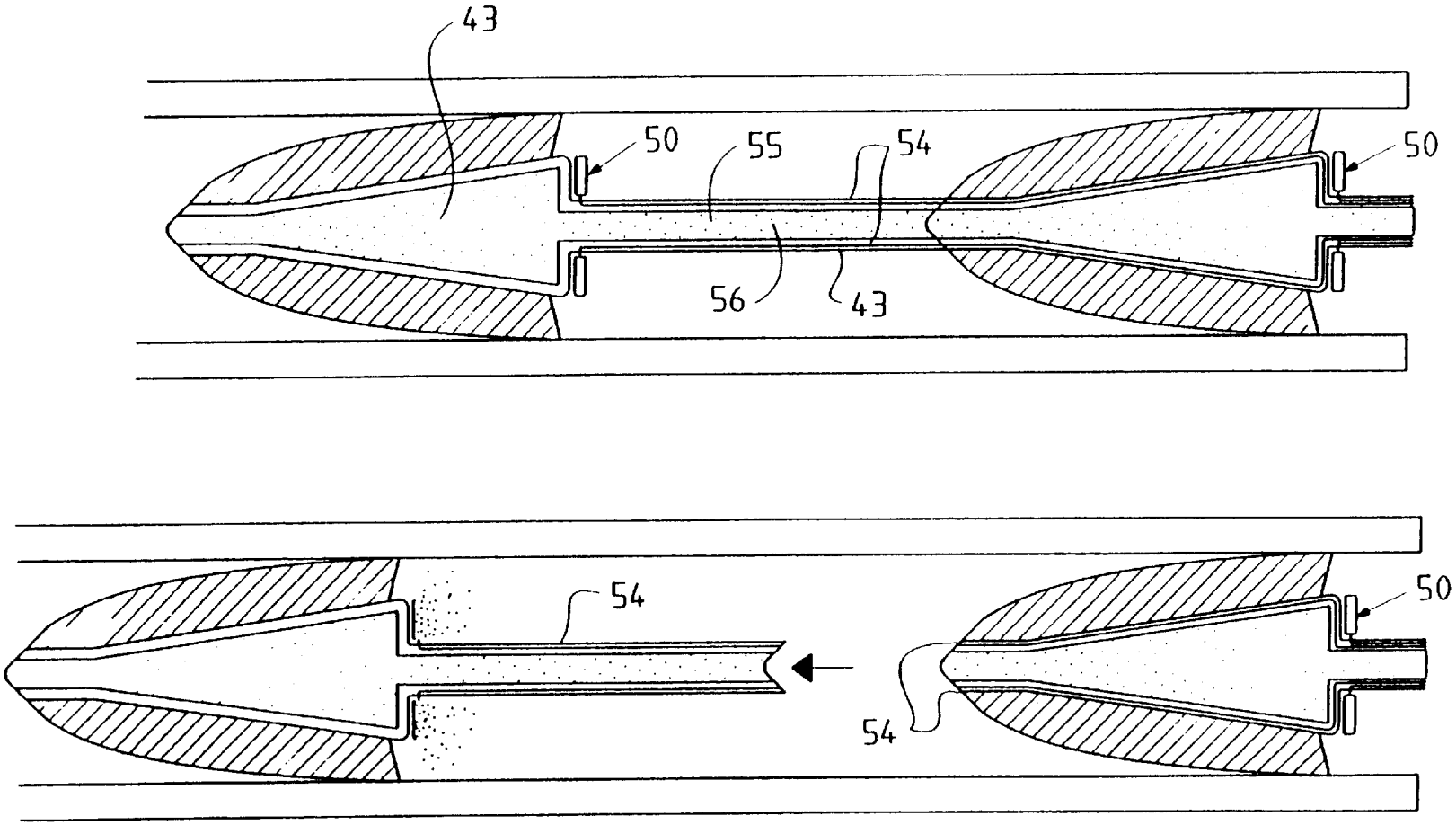
FIG. 5 illustrates a further embodiment which is similar to that of FIG. 4.

FIG. 5 illustrates a embodiment which is similar to FIG. 4. However the electrical circuits for igniting the primers 50 are individually hard wired along the column 55 through the insulated space 43, which also extends along the rear spine extension 56, and operated separated by a control circuit. These wires 54 break away upon firing the respective projectile.

Figure 6A:
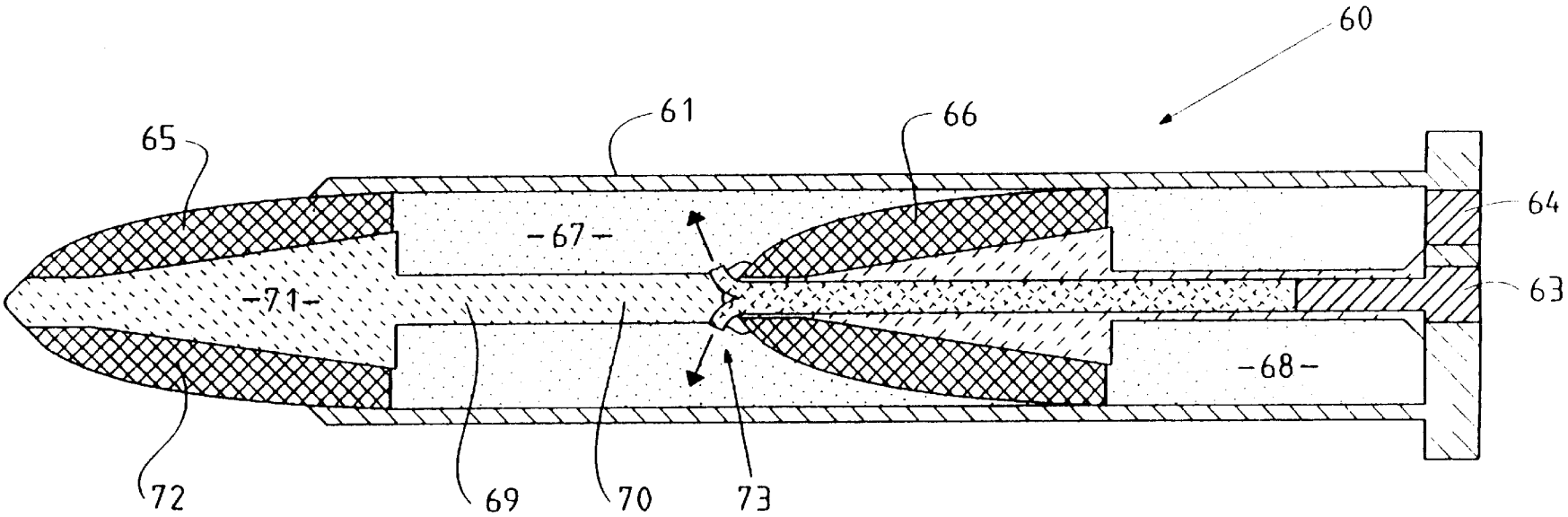
FIG. 6*a* illustrates one form of double-tap ammunition.

FIG. 6*a* illustrates a preferred form of double-tap round 60 comprising a shell 61 having a flanged base 62 supporting a centre-fire primer 63 and a rim-fire primer 64, a leading projectile 65, a trailing projectile 66 and propellant charges 67 and 68 associated with the respective projectile 65 and 66.

Each projectile includes a spine part 69 which has a trailing column portion and a leading tapered mandrel portion 71 about which the nose 72 of the bullet extends such that firing of the projectile will force the mandrel 71 into the nose part to spread it into sealing engagement with the barrel. The column portion of the trailing projectile is hollow and is provided with leading outlet ports 73 which communicate with the leading propellant charge 67.

This arrangement is provided so that firing of the centre-fire primer 63 will ignite the leading propellant charge 67 only, the rear propellant charge 68 being ignited by the rim-fire primer 64. The firing rate of the two projectiles may be set as desired by arranging the firing pin associated with the rim-fire primer to engage its primer slightly behind the firing pin for the centre-fire primer.

Figure 6B:
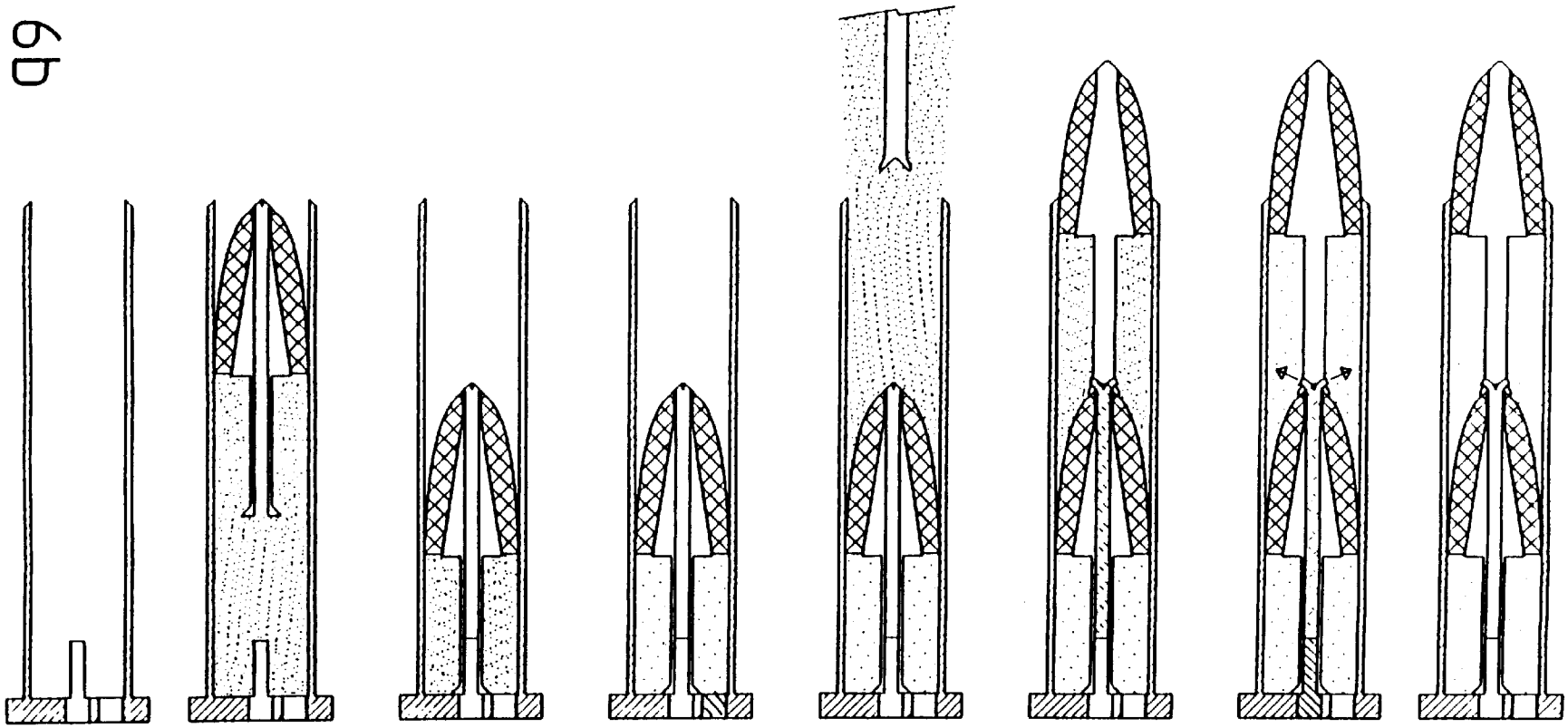
FIG. 6*b* illustrates the sequence from loaded to cartridge ejection of the ammunition illustrated in FIG. 6*a*.

As shown in the sequenced drawings of FIG. 6*b*, the sequence commences with initial contact of the centre-fire primer directing the primer burn to the leading propellant 67 which then ignites resulting in firing of the leading projectile. This firing forces the trailing projectile nose rearwardly over the mandrel part effecting a seal with the barrel preventing consequent ignition of the second propellant charge 68. This occurs upon the delayed striking of the firing pin associated with the rim fire primer causing ignition of the propellant and firing of the second projectile.

After both projectiles have been fired, the empty case is mechanically ejected in conventional manner to enable a further cartridge to be loaded from the magazine. Both 35 projectiles can be fired independently if desired or set to fire automatically in quick succession up to a rate of 45,000 rounds per minute, for example.

Figure 7A:
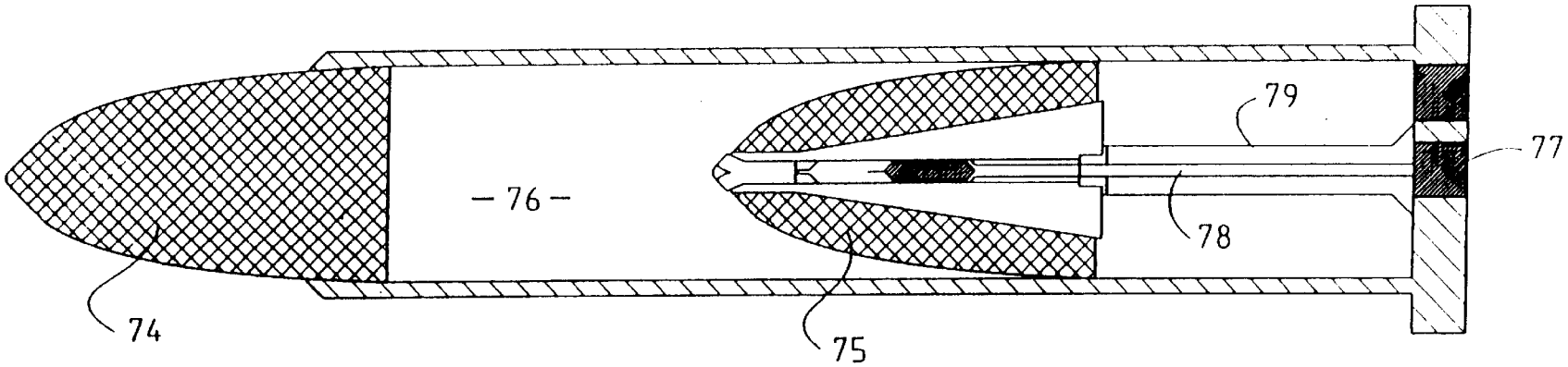
FIGS. 7*a* to 7*d* illustrate further forms of double-tap ammunition.

FIG. 7*a* illustrates a further form of double tap ammunition. In this embodiment, the projectiles are spineless, the leading projectile 74 being of conventional form and being spaced from the trailing projectile 75 by a propellant charge 76. The centre fire primer 77 is supported at the nose of the trailing projectile 75 and is associated with a pin extension 78 extending through a central spine 79 associated with the centre fire primer. In this embodiment, the firing pin extension 78 seals the central passage within the second projectile 75 after firing has been effected to prevent gas leakage from the second propellant burn.

Figure 7B:
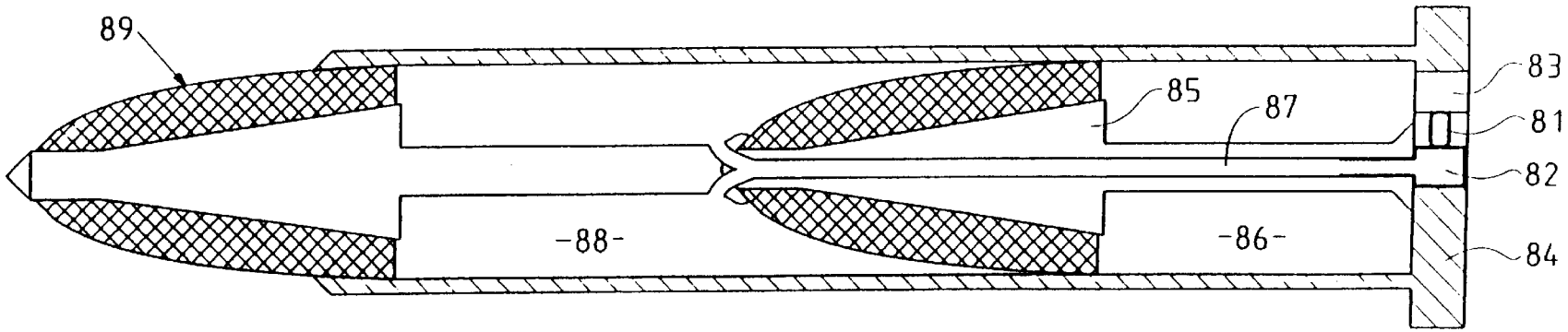

In a further variation of cased ammunition according to the present invention, shown cutaway in FIG. 7*b*, ignition of the propellant associated with the trailing projectile may be achieved through a fuse 81 in the end cap 84 interconnecting the centre fire primer 82 with the rim primer 83 such that the centre fire primer 82 may be utilised to fire the propellant 88 for the first projectile 89 whereafter the second projectile 85 will fire at a preselected time delay determined by the time required for ignition of the second primer 83 through the fuse 81, igniting the propellant 86. Ignition of the leading propellant, not shown, is through the hollow spine 87.

Figure 7C:
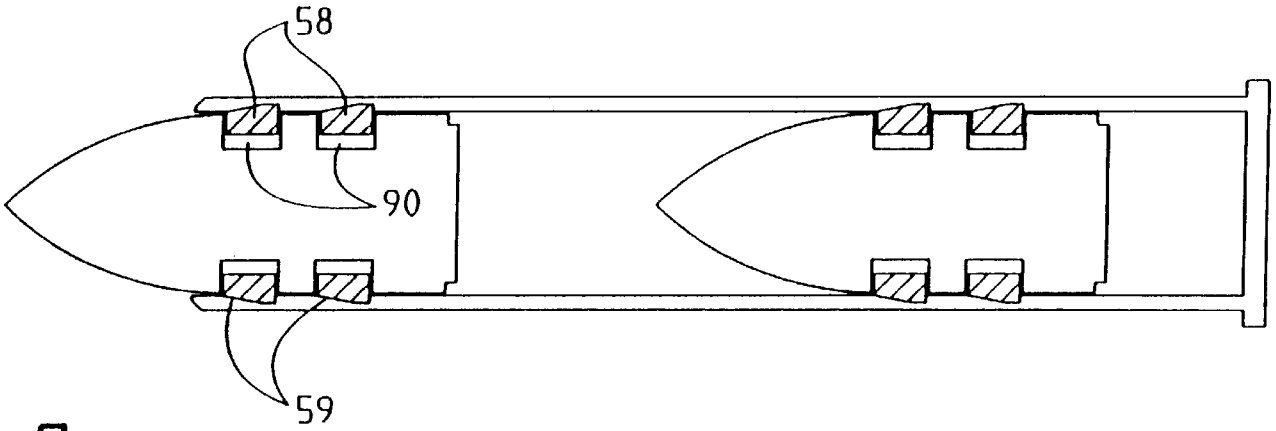
Figure 7D:
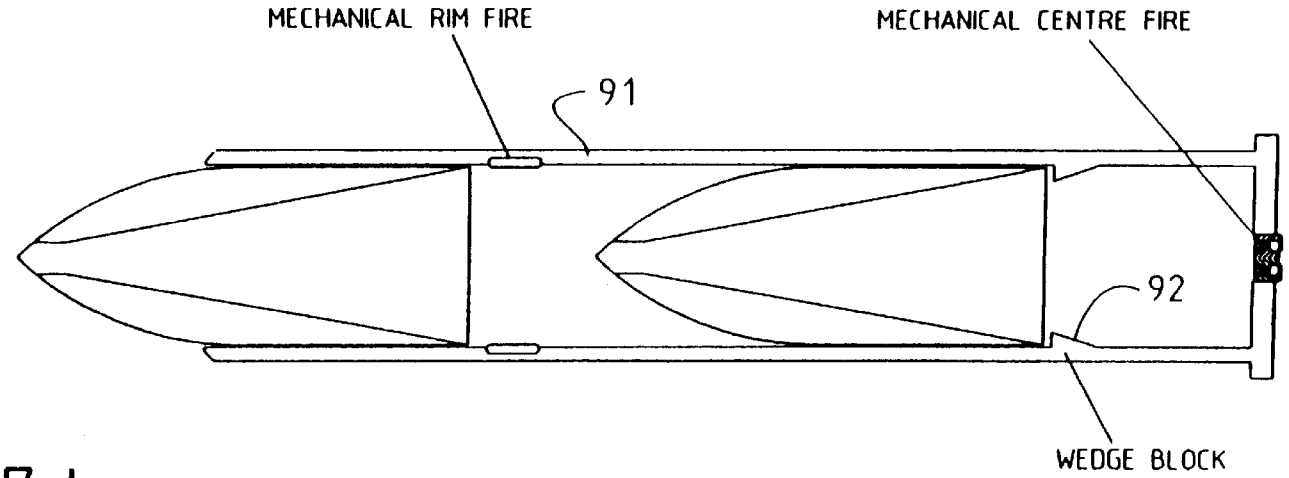

In the cased ammunition embodiment illustrated in FIGS. 7*c* and 7*d* locating means are utilised to positively locate the projectiles in place in their respective barrels. In the FIG. 7*c* embodiment retractable wedge shaped rings 58 locate in grooves 59 in the casing and retract into their projectile grooves 90 upon firing. Alternatively as illustrated in FIG. 7*d*, the casing 91 may be provided with a internal annular ledge 92 against which the projectile seats.

Figure 8:
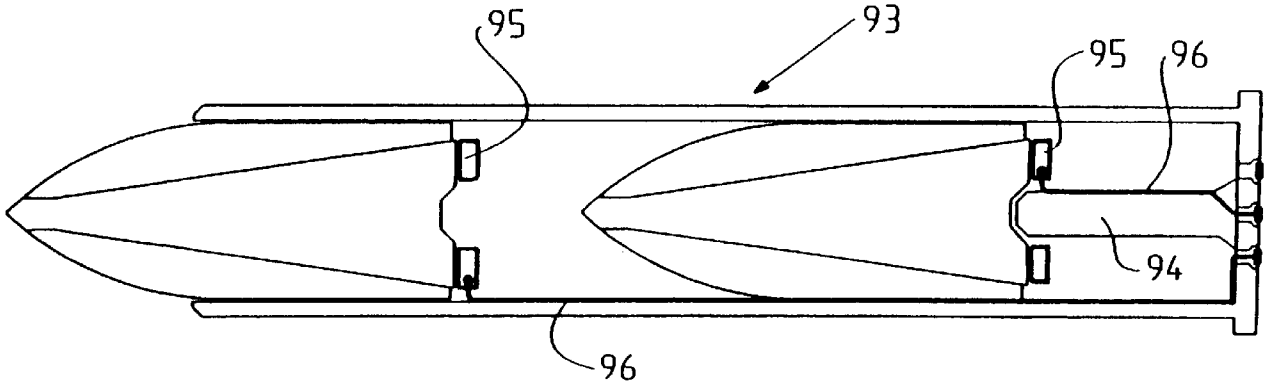
FIG. 8 illustrates an electrically fired form of cased ammunition.

The electrically fired form of cased ammunition 93 illustrated in FIG. 8 utilises a spine 94 independent of the projectile and electrically operated primers 95 connected by leads 96 to contacts for completing the firing circuit formed by the leads and the casing.

Figure 9:
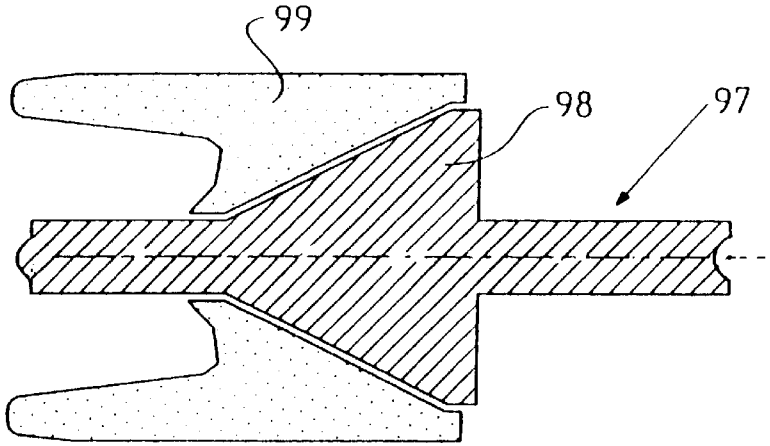
FIG. 9 illustrates a high energy transfer projectile for use with the double tap ammunition or a barrel assembly of the type described.

Of course the projectile assemblies of the present invention can be bullet shaped as previously illustrated or as illustrated in FIG. 9 they may include a steel spine portion 97 having a wedge shaped central portion 98 of sufficient size to cause rupturing of the hollow nose part 99 when the latter is slowed by impact with an object. Thus in this embodiment the wedge shaped central portion 98 performs the dual functions of a mandrel for sealing engagement of the nose part with the barrel during firing and for shattering the nose part upon impact. The nose part and the central portion may be so formed as to cooperate in such manner that, upon striking an object, the energy of the central part is mostly dissipated in an outward splaying and/or shattering of the nose part, or so that much of the energy of the central portion remains therewith, such as to enable it to penetrate protective vests and the like.

Figure 10:
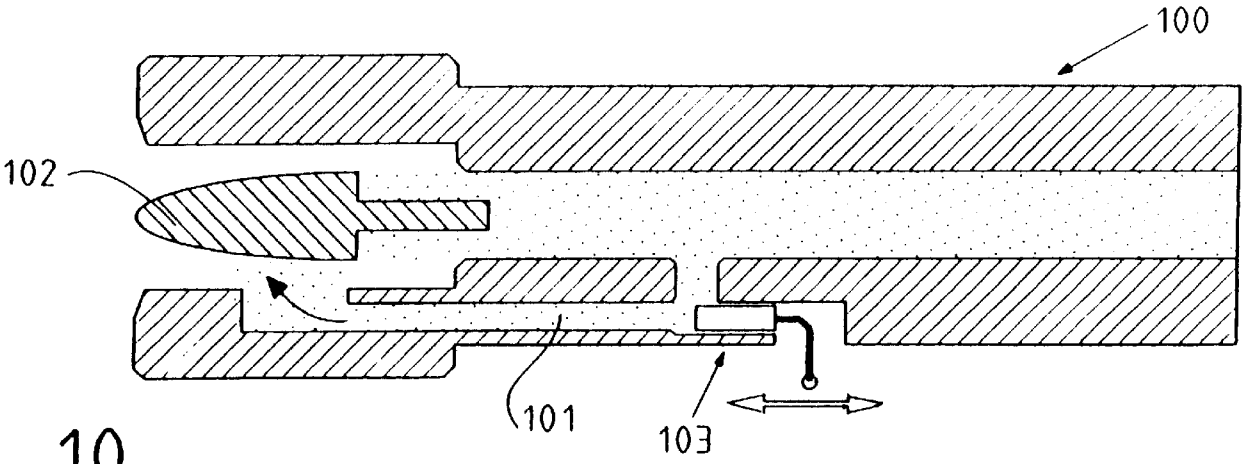
FIG. 10 illustrates an end part of a barrel assembly provided with projectile deflecting means.

The double tap ammunition of the present invention is provided as a means for increasing the probability of a user striking the target with one shot. This can be further enhanced in a multi barrel type weapon by, for example, arranging three barrels concentrically about a longitudinal axis and inducing a lateral deflection in the projectiles propelled from the barrels. Suitably this is achieved, as illustrated in FIG. 10, by providing a barrel assembly 100 having a bleed bypass passage 101 which exits to the muzzle so as to provide a lateral force on the projectile 102 as it exits the muzzle. Suitably the bypass passage 101 is provided with a control valve 103 which may be slid forwards to close the passage 101 for normal non-deflected operation. The on/off valve 103 is associated with a pistol grip or other means so that a user may quickly change the mode of operation of the weapon. Placing three barrels, or more, concentrically about a longitudinal axis and forming the bypass passage 101 along their innermost portions, ensures that the combined lateral forces acting on the weapon as a result of the bypass reactions will total zero.

If desired, the inlet to the bypass passage 101 may be positioned for receipt of gases from a trailing propellant burn, sacrificing some energy of a trailing projectile for deflecting a leading projectile without loss of energy of the leading projectile.

The barrel assembly of the present invention may be in the form of a replaceable cartridge. For example, a barrel assembly containing projectiles, primers and propellant as illustrated in FIG. 4 or 5 may constitute a replacement cartridge for a single barrel hand gun. In such an arrangement a hand gun could be provided with a battery operated control circuit in the handpiece controlled by a switch so that an operator could control firing of the weapon to single round firing or firing of all six rounds at a rapid rate.

Figure 11:
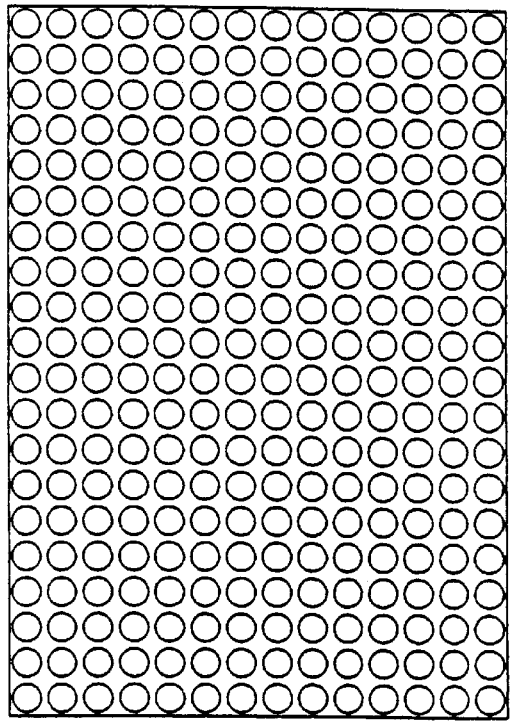
FIG. 11 illustrates a barrel arrangement for a multiple barrel array.

Furthermore, by using the barrel assembly of the type illustrated in FIGS. 4 and 5, the barrels may be arranged in a honeycomb fashion such as is illustrated diagrammatically in section in FIG. 11 which shows a pod of two hundred and eighty, 9mm barrels, each containing respective projectile and propellant assemblies occupying a 50mm length of the barrel of which the projectile constitutes about 20mm. Thus for example, a barrel containing twenty projectiles would be in the order of one and one half metres long, providing a free barrel end space beyond the outermost projectile of about 500mm. Such barrels in a pod of two hundred and eighty, would contain 5,600 projectiles which could be fired in rapid succession or in bursts to suit the situation. Typically such barrel pods would be formed as disposable units but if desired, the barrel assembly could be adapted to be reloaded with armed sleeves.

Typical weapons which may utilise replacement cartridges include a machine gun which could include an LCD screen enabling an operator to program the firing sequence required. Single barrel sleeves could also be loaded into a conventional style revolver having a loading gate containing six chambers, three of which may be in a firing position at any one time, the other three being in a reloading position.

Figure 12:
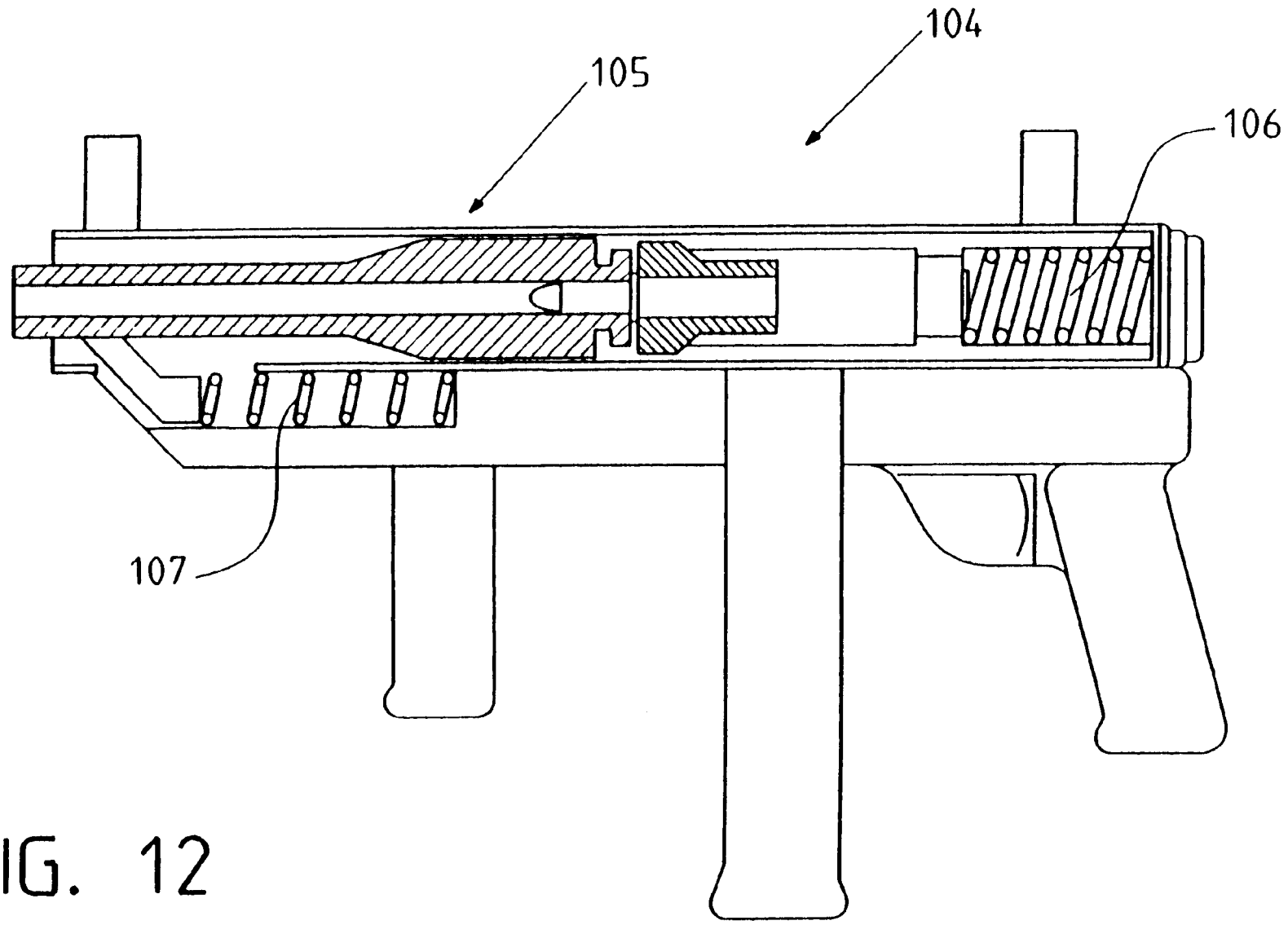
FIG. 12 illustrates a weapon adapted for the double-tap ammunition.
Figure 13:
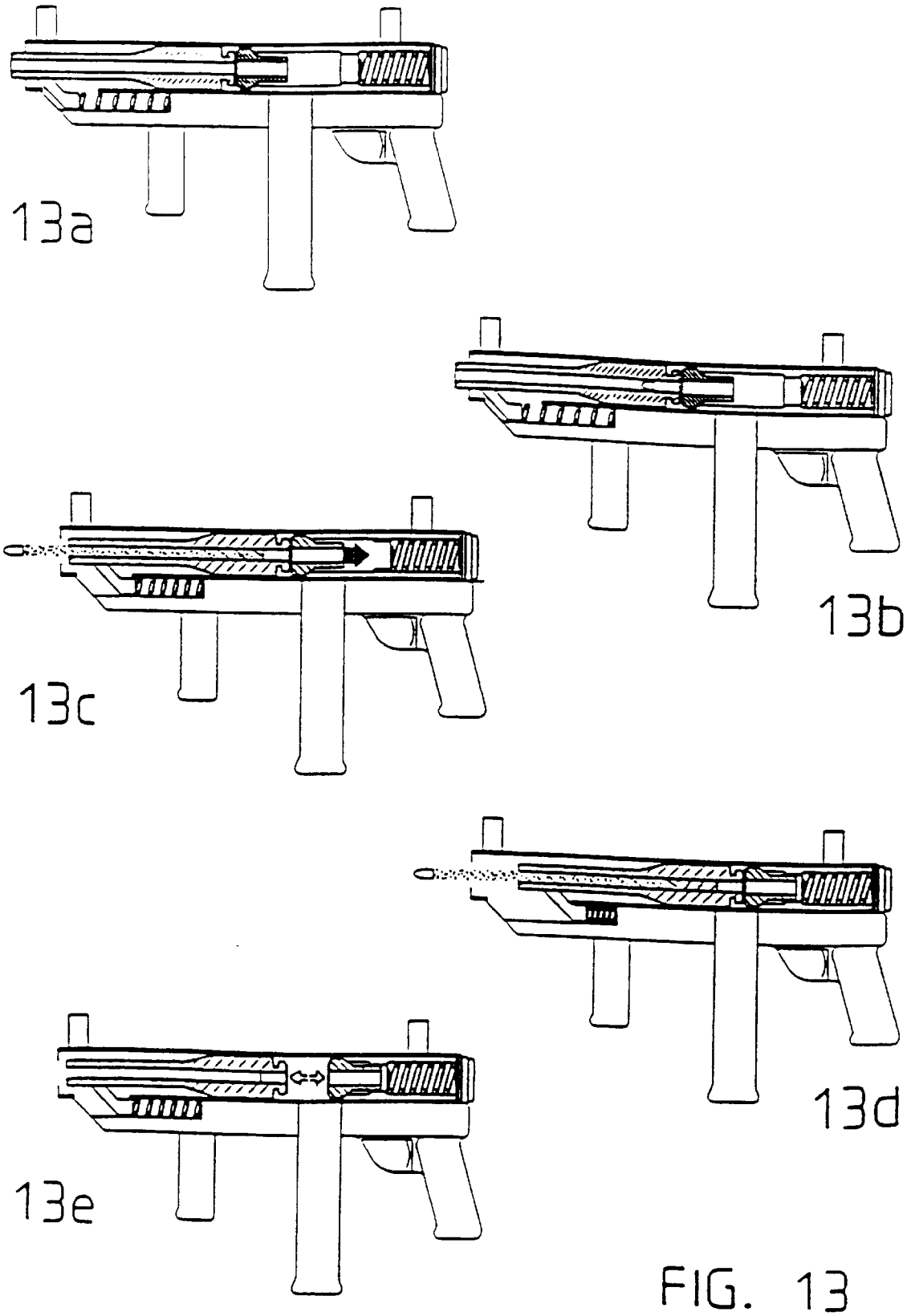
FIGS. 13*a* to 13*e* illustrate the operational sequence of the weapon of FIG. 13.

A preferred form of machine gun like weapon 104 according to the present invention, illustrated in FIG. 12, utilises double tap ammunition having a barrel and breech block 105 in somewhat conventional manner, however as illustrated in this embodiment, both the barrel and breech block are provided with respective recoil return springs 106 and 107. The ammunition is arranged to fire both projectiles from each cartridge prior to either the breech block or the barrel assembly reaching its recoil travel limit so that the projectiles are not deflected from their course by the recoil action. In this respect it will be seen that the barrel and breech block 105 recoil together against the action of the recoil spring 107 associated with the barrel which reaches its limits prior to contact between the breech block and its recoil spring 106 such that the breech block may recoil to a greater extent than the barrel assembly, ejecting the empty case in the process and receiving a further round from the magazine for loading into the barrel assembly. This sequence is illustrated in FIGS. 13*a* to 13*e*.

Figure 14A:
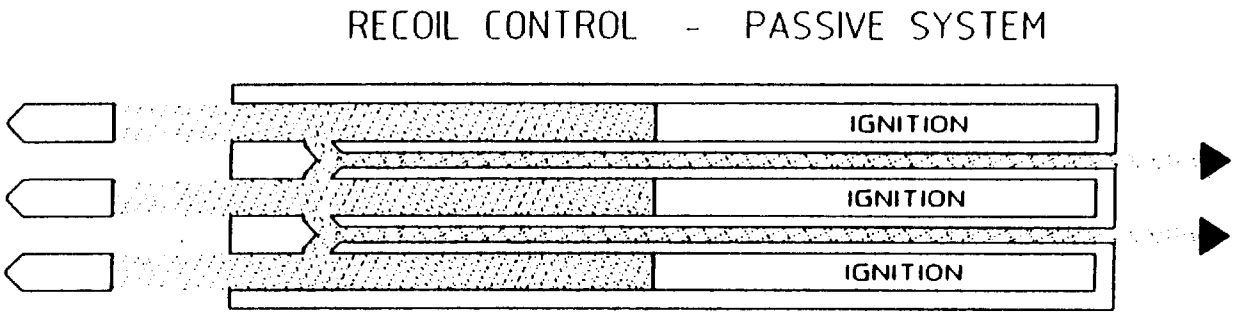
FIGS. 14*a* and 14*b* illustrate recoil control arrangements.
Figure 14B:
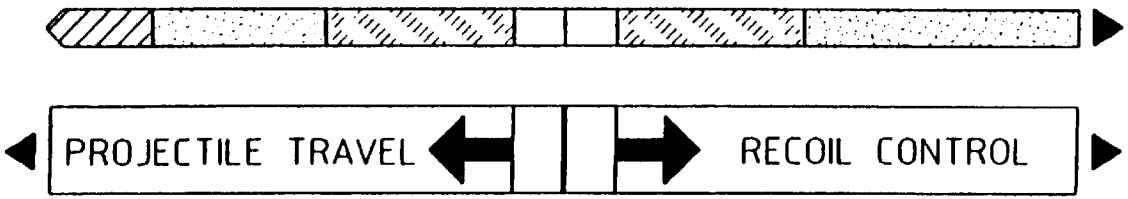

In weapons in which the recoil would effect the stability of the article or person carrying the weapon, either passive muzzle vents may be used to reduce recoil, such as is illustrated diagrammatically in FIGS. 14*a* and 14*b*, or an active system may be used may fire blank changes or the like in an opposing direction to reduce the direction to an extent where it has a substantially negligible effect.

Figure 15:
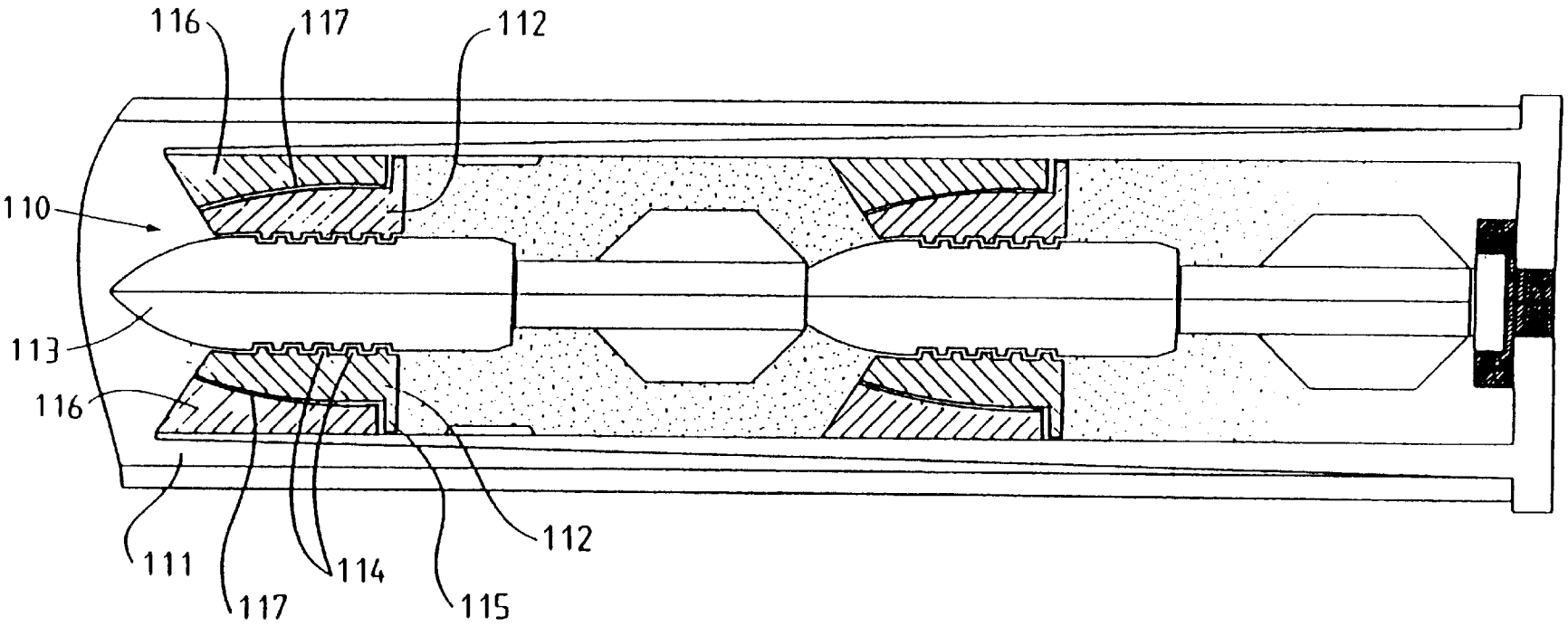
FIG. 15 illustrates a further projectile form.

The embodiment illustrated in FIG. 15 utilises a fall away sabot assembly 110 to increase the bore diameter of the barrel 111 whereby the length of the propellant space may be minimised enabling more rounds to be carried in a given barrel length. In this embodiment the sabot assembly comprises anvil sectors 112 which form an annular inner ring engaged about the projectile nose 113 and located in circumferential grooves 114 in the projectile nose. These parts also form a rear flange 115 which extends to the barrel wall to form a rear abutment for outer malleable sectors 116 which form a complementary collar about the anvil sectors 112.

It will be seen that the complementary joining faces 117 of the sabot sectors 112 and 116 taper rearwardly and outwardly whereby relative rearward movement of the outer sectors 116 over the inner sectors 112 will force them into sealing engagement with the barrel as the projectile is propelled through the barrel with propellant thrust on the flange 115 being transmitted to the projectile through its engagement with the grooves 114.

Immediately upon exit from the barrel, the nonstreamlined sabot parts will be free of the barrel constraint holding them together and will subsequently fall away or spin off from the projectile. As the projectile has a diameter which is less than the diameter of the barrel bore, the trailing stem portion 118 can be provided with trailing fins for enhanced directional stability.

Figure 16:
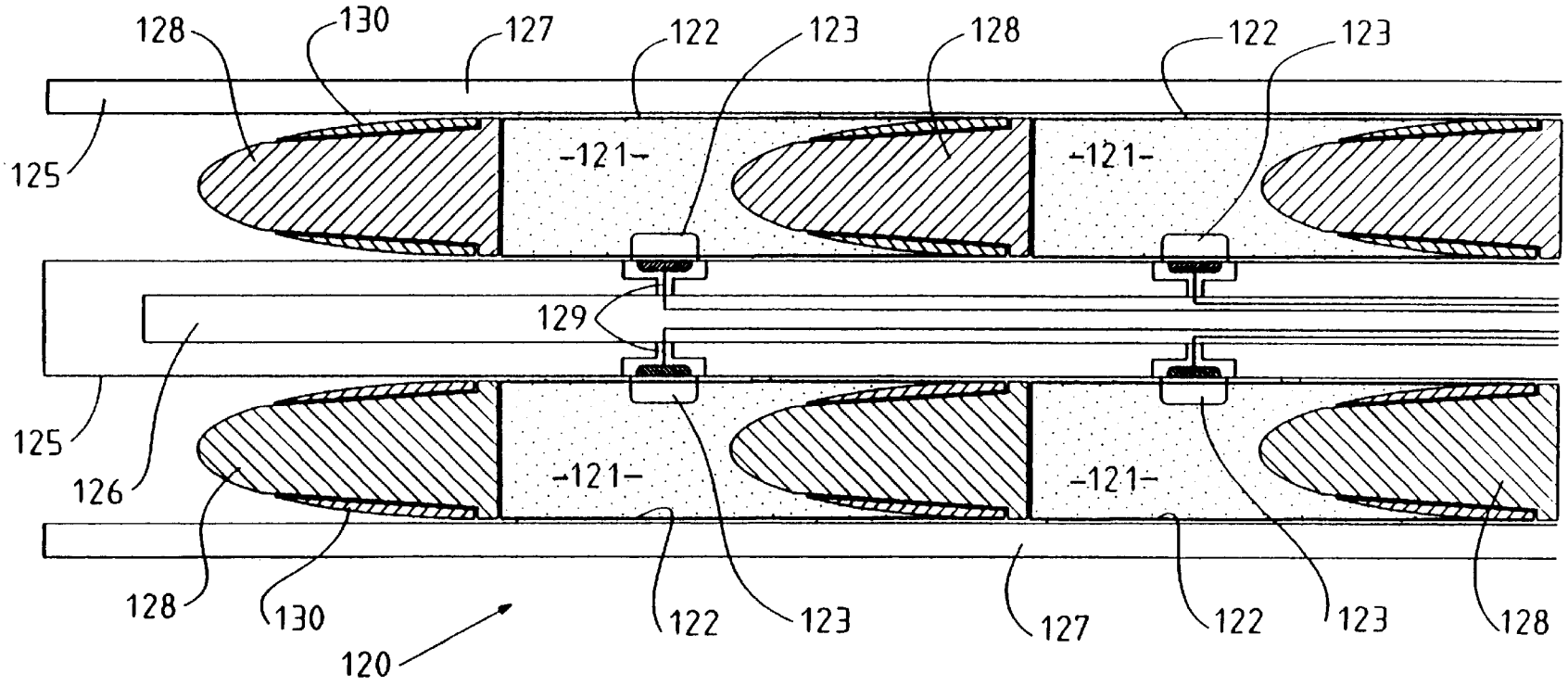
FIG. 16 is a diagrammatic sectional view of a four barrel cluster.
Figure 17:
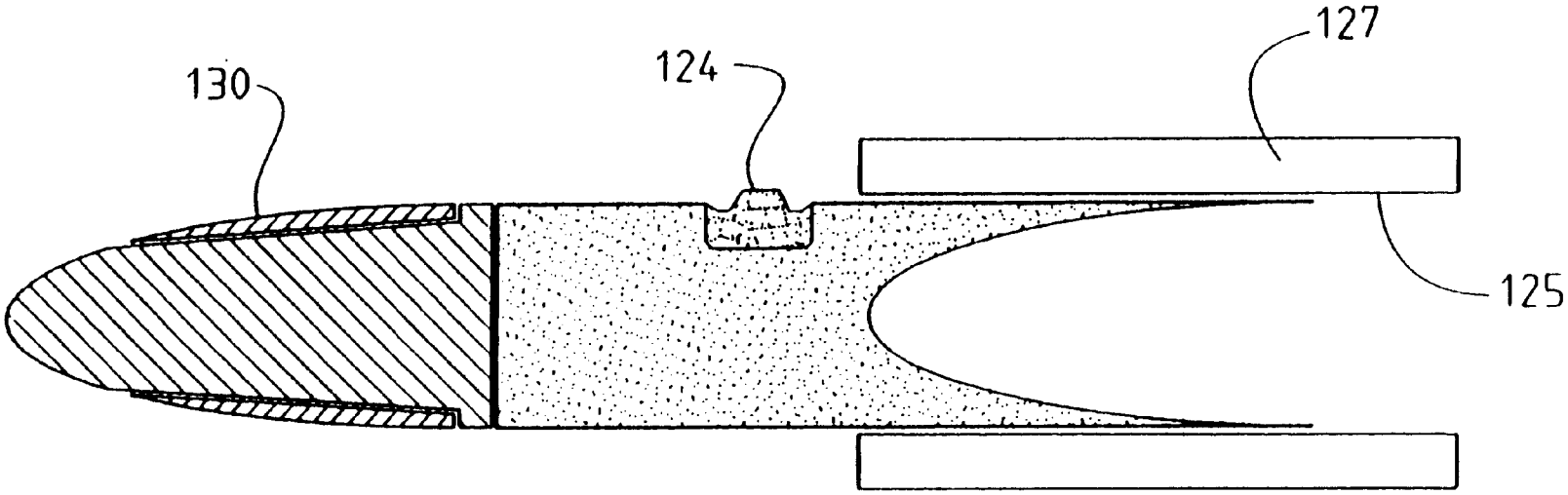
FIG. 17 illustrates the loading mechanism for the embodiment of FIG. 16.

The four barrel embodiment 120 illustrated in FIGS. 16 and 17 utilises cased propellant charges 121 in which the propellant is encased in a metal casing 122 which provides the longitudinal stiffness required for maintaining the spaced projectiles on their operative positions. Each casing 122 has an embedded primer 123 formed with a retractable contact 124, which normally extends outwardly beyond the bore 125, but which may be retracted to enter the bore for movement of the casing 122 to its operative position in the barrel coincident with a recessed electrical contact 129. Once in position the retractable contact 124, extends to make operative contact with the recessed electrical contact 129.

In this embodiment the wires for the recessed electrical contacts 129 are contained in the central space 126 about which the barrels 127 are symmetrically arranged. It will also be seen that the front end of the casing 122 is flat and abuts the flat rear end of the projectile body 128. The intermediate portion of the body 128 is frusto-conical shaped and support an axially slidable malleable collar 130. A portion of the collar 130 abuts with the trailing end of the casing 122 so that the collar is forced rearwardly and thus expanded radially to provide an effective barrel seal upon application of the rearward force imparted by the leading casing 122 associated with firing of the propellant therein.

Thus a relatively simple and barrel assembly may be formed in which the electrical components are concealed and which and which may be simply loaded and possibly reloaded.

It will of course be realised that the above embodiments have been given only by way of illustrative example of the invention herein and that all such modifications and variations thereto as would be apparent to persons skilled in the art are deemed to fall within the broad scope and ambit of the invention and particularly as is defined in the appended claims.

The claims defining the invention are as follows:

1. A barrel assembly containing adjacent projectiles, wherein adjacent projectiles are separated from one another, and maintained in spaced apart relationship by locating means independent of the projectiles, said assembly comprising:

(A) a plurality of adjacent projectiles forming a cased round, including:

(i) a case adapted for retention in a breech assembly and serving functionally as the bore of the barrel;

(ii) at least two projectiles disposed one behind the other in the case and each seating peripherally with the case, each projectile including expandable sealing means for functionally forming an operative seal with the bore of the barrel;

(iii) respective propellant charges within the case and behind each projectile, (iv) ignition means for igniting the propellant charges in a predetermined sequence; and (v) locating means independent of said projectiles for separating adjacent projectiles from one another and maintaining them in spaced apart relationship; and (B) an electrical ignition system for sequentially igniting the propellant charges of the barrel assembly, including:

(i) means for igniting the leading propellant charge by sending an ignition signal through the stacked projectiles, and (ii) means for causing ignition of the leading propellant charge to arm the next propellant charge for actuation by the next ignition signal.

2. The assembly of claim 1 additionally including a gas bypass passage adjacent the muzzle which feeds propellant gases back to the barrel in the path of an outgoing projectile.

* * * * *